US006497173B1

(12) United States Patent
Dalland

(10) Patent No.: US 6,497,173 B1
(45) Date of Patent: Dec. 24, 2002

(54) AGGREGATE OF PRESSURE CYLINDERS

(76) Inventor: Knut O. Dalland, N-5281 Valestrandsfossen, Valestrandsfossen (NO)

( * ) Notice: Subject to any disclaimer, the term of this patent is extended or adjusted under 35 U.S.C. 154(b) by 0 days.

(21) Appl. No.: 09/623,280

(22) PCT Filed: Mar. 2, 1999

(86) PCT No.: PCT/NO99/00072

§ 371 (c)(1),
(2), (4) Date: Nov. 22, 2000

(87) PCT Pub. No.: WO99/45279

PCT Pub. Date: Sep. 10, 1999

(30) Foreign Application Priority Data

Mar. 2, 1998 (NO) ..... 980894

(51) Int. Cl.[7] ..... F01B 1/00
(52) U.S. Cl. ..... 92/146; 92/165 R
(58) Field of Search ..... 92/66, 146, 165 R, 92/166, 165 PR

(56) References Cited

U.S. PATENT DOCUMENTS

| | | | | |
|---|---|---|---|---|
| 1,687,369 A | * | 10/1928 | Lapointe | 92/166 |
| 3,250,182 A | | 5/1966 | Nansel | |
| 4,412,476 A | * | 11/1983 | Benaroya | 92/146 |
| 4,733,598 A | | 3/1988 | Innes et al. | |
| 5,431,087 A | * | 7/1995 | Kambara | 92/146 |
| 5,651,302 A | * | 7/1997 | Mills | 92/165 R |

* cited by examiner

*Primary Examiner*—F. Daniel Lopez
(74) *Attorney, Agent, or Firm*—Reed & Associates

(57) ABSTRACT

An aggregate (10') of pressure medium cylinders (11', 12') are used especially where there is required a relatively large length of stroke. At least a first (11') and at least a second (12') pressure medium cylinder are arranged by the side of each other with their longitudinal axes (11*a*, 11*b*) extending mutually parallel. The cylinder parts (13', 14') of the cylinders are rigidly connected to each other at least in pairs. Piston rods (17', 18') of said first and second cylinders are turned respectively in pairs in mutually opposite axial directions.

12 Claims, 4 Drawing Sheets

AGGREGATE OF PRESSURE CYLINDERS

Figure 1:
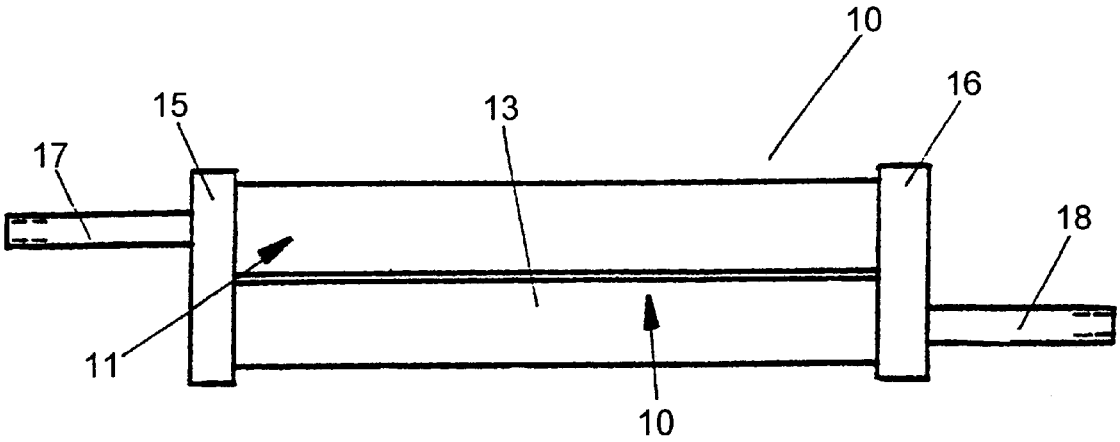
FIG. 1 Prior Art

The present invention relates to an aggregate of pressure medium cylinders, especially for use where a relative large length of stroke is required. More specifically the invention comprises an aggregate of pressure medium cylinders where the piston rod of a first cylinder is directed away from the piston rod of a second cylinder where the cylinder portions of the cylinders are rigidly connected to each other and where the longitudinal axes of the cylinders run parallel to the longitudinal axis of the aggregate.

By the term "medium" is meant preferably a gaseous or liquid fluid which is employed to drive the cylinders in the aggregate. On pressure setting each cylinder chamber with a gaseous or liquid fluid, the respective piston rod is pushed out, and reversely, on venting off the fluid from the cylinder chamber, the piston rod is drawn into the cylinder.

A usual problem with pressure medium cylinders, which have a relatively large length of stroke, is that they become unstable during use and are apt to break at the transition from cylinder to piston rod.

Attempts have been made to remedy this drawback by employing an aggregate of pressure medium cylinders in the form of a number of double acting telescopic cylinders, that is to say a number of cylinders which are arranged along a common central axis. However such an aggregate has a weakness having relatively thin piston rods in the final telescopic link and a corresponding danger of breaking at the transition from cylinder to piston rod in said final telescopic link.

In U.S. Pat. No. 4,733,598 a telescopic arrangement is referred to which comprises a simple aggregate of three telescopic pipes together with only two oppositely directed pressure medium cylinders. The cylinders are disposed side-by-side, that is to say roughly on each side of the central axis of the telescopic arrangement. The cylinders are secured to a telescopic pipe radially most central, while the respective piston rod has the outer end secured to a telescopic pipe radially outermost or radially innermost. The two cylinders are disposed side-by-side on each side of the central axis of the telescopic arrangement. The construction necessarily provides an oblique load between the outer ends of the piston rods in a direction which extends obliquely of the central axis of the aggregate/telescopic arrangement. The surrounding telescopic pipes are correspondingly obliquely loaded by the pressure medium cylinders, especially in the fully pushed out condition of the piston rods.

In U.S. Pat. No. 3,250,182 there is referred to according to FIGS. 1–7 a simple cylinder aggregate of a kind equivalent to that described in the afore-mentioned U.S. Pat. No. 4,733,598. In FIGS. 8–9 an arrangement is shown of a still simpler kind, without telescopic pipes and without a mechanical connection between the pressure medium cylinders, that is to say for completely different purposes than according to the invention.

With the present invention the aim is an aggregate having a robust and operatively reliable construction practically, where inter alia the danger of breakage of piston rods during use is reduced.

The aggregate according to the invention is characterised in that a number of cylinders of a first type and a number of cylinders of a second type are arranged in an annular group about the longitudinal axis of the aggregate, the cylinders of the first type being received in intermediate spaces between cylinders of the second type, while the piston rods of the first type of cylinders are rigidly connected to each other at associated outer ends, and the piston rods of the second type of cylinder are mutually rigidly connected to each other at associated outer ends.

By arranging pressure medium cylinders of a multi-cylindered cylinder aggregate according to the invention double stroke length and a multiple outgoing power can generally be achieved, that is to say double outgoing power in an aggregate of two cylinders and quadruple outgoing power in four cylinders, etc.

Consequently with a robust construction, but nevertheless a relatively short cylinder portion, there can be achieved a relatively large stroke length and simultaneously a relatively large outgoing power.

According to a first embodiment of the invention the aggregate is further characterised in that the cylinders of the first type are equipped with a first common power transmitting slide, and the cylinders of the second type are equipped with a second common power transmitting slide, the slides being arranged centrally between the cylinders and being slidable along a common central axis.

By means of the slides the accumulated outgoing power of the aggregate can be conveyed along the common central axis and relieve in an effective manner flexural stresses which otherwise would be able to occur in the piston rods.

According to a second embodiment of the invention the aggregate is further characterised in that the cylinder portions of the cylinders are made coherently of a common piece of material.

According to a third embodiment of the invention the aggregate is further characterised in that the piston rods of the first cylinders are at respective outer ends mutually rigidly connected to each other via their respective first local fastening points in a first plane, and that the piston rods of the second cylinders are at the outer end mutually rigidly connected to each other via their respective second local fastening point in a second plane which crosses the first plane.

By means of the annular arrangement of cylinders the total outgoing power can be readily localised along a common central axis, one being able to ensure with a mutually rigid connection between the piston rods at each of the ends of the aggregate that the total out going power of the aggregate can be conveyed along the common central axis. In addition flexural stresses, which could otherwise occur in the piston rods, can be relieved in an effective manner.

Consequently in the invention a larger number of pressure medium cylinders is employed than that which is known previously. With the new solution pressure medium cylinders which have the same piston outward displacement direction, can be placed in pairs, diametrically above each other on their respective sides of the central axis of the aggregate.

According to the invention the oblique loads which arise according to the US publications can be avoided. Consequently according to the invention the possibility is achieved for a more reliable mode of operation and the possibility for transmitting significantly greater pushing forces than those which are possible according to the US publications. According to the invention it is consequently a question of a new solution and a considerable advance in the field.

Further features of the present invention will be evident from the following description having regard to the accompanying drawings, in which:

FIG. 1 shows an aggregate, as known per se, comprising a pair of mutually parallel pressure medium cylinders with mutually oppositely directed piston rods.

Figure 1A:
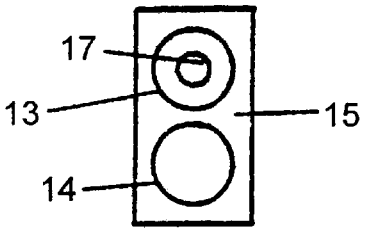
FIG. 1a Prior Art
Figure 1B:
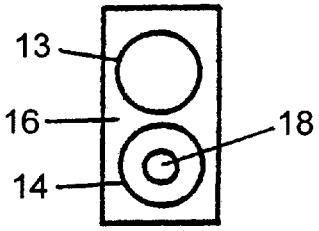
FIG. 1b Prior Art

FIGS. 1*a* and 1*b* shows the aggregate according to FIG. 1 illustrated in end view, seen from two opposite ends.

Figure 2:
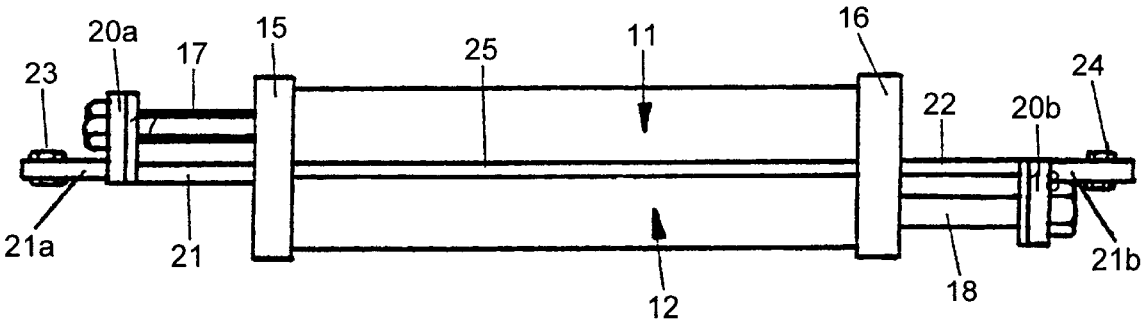

FIG. 2 shows in a first embodiment a modified design of the aggregate according to FIG. 1, constructed as according to the invention. For the sake of clarity the drawing shows only the one of a first pair of diametrically opposite cylinders and the one of a second pair of equivalent diametrically opposite cylinders. Besides FIG. 2 shows the cylinder aggregate turned 90° relative to the position illustrated in FIG. 3.

Figure 2A:
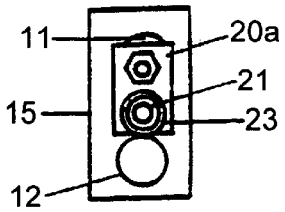
Figure 2B:
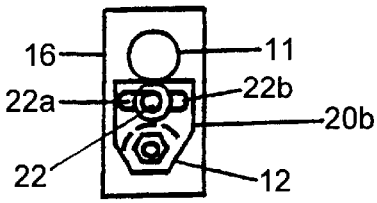

FIGS. 2*a* and 2*b* show the aggregate according to FIG. 2 illustrated in end view, seen from two opposite ends. For the sake of clarity only the one half of the aggregate is illustrated.

Figure 3:
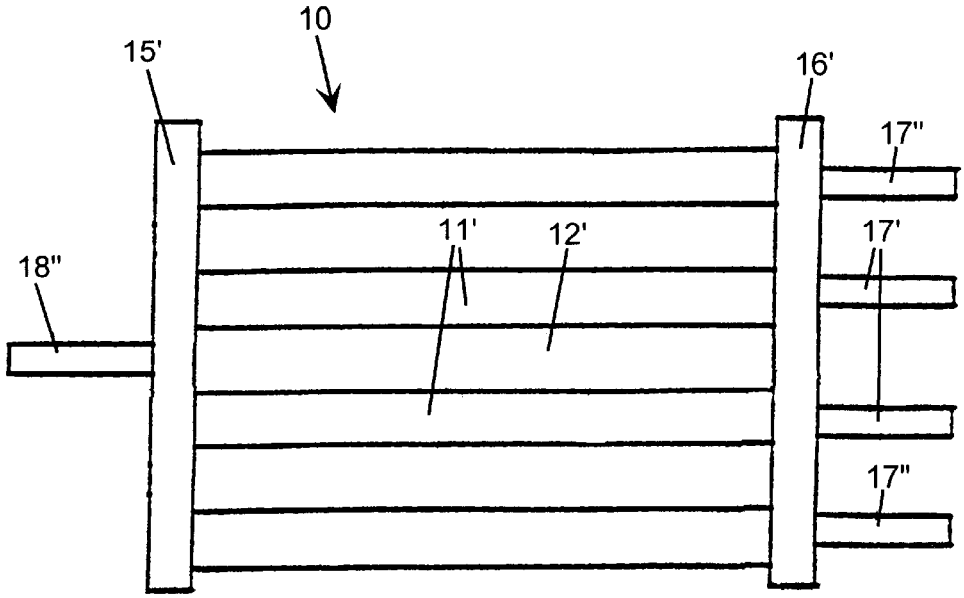

FIG. 3 shows in a second embodiment an aggregate according to the invention of two pairs of mutually parallel pressure medium cylinders whose piston rods are arranged in pairs in opposite directions.

Figure 3A:
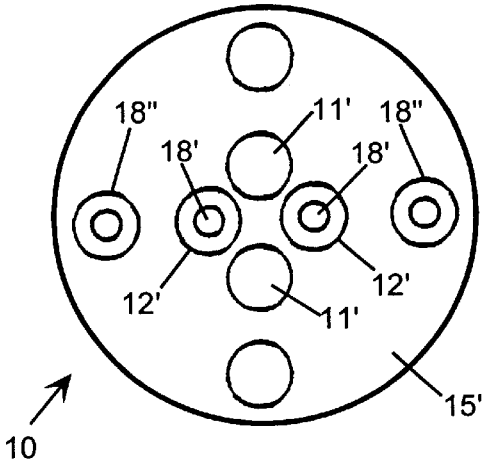
Figure 3B:
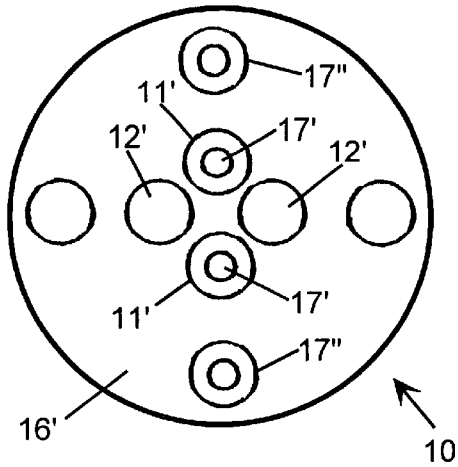

FIGS. 3*a* and 3*b* show end views of the aggregate according to FIG. 3, seen from opposite ends.

Figure 4:
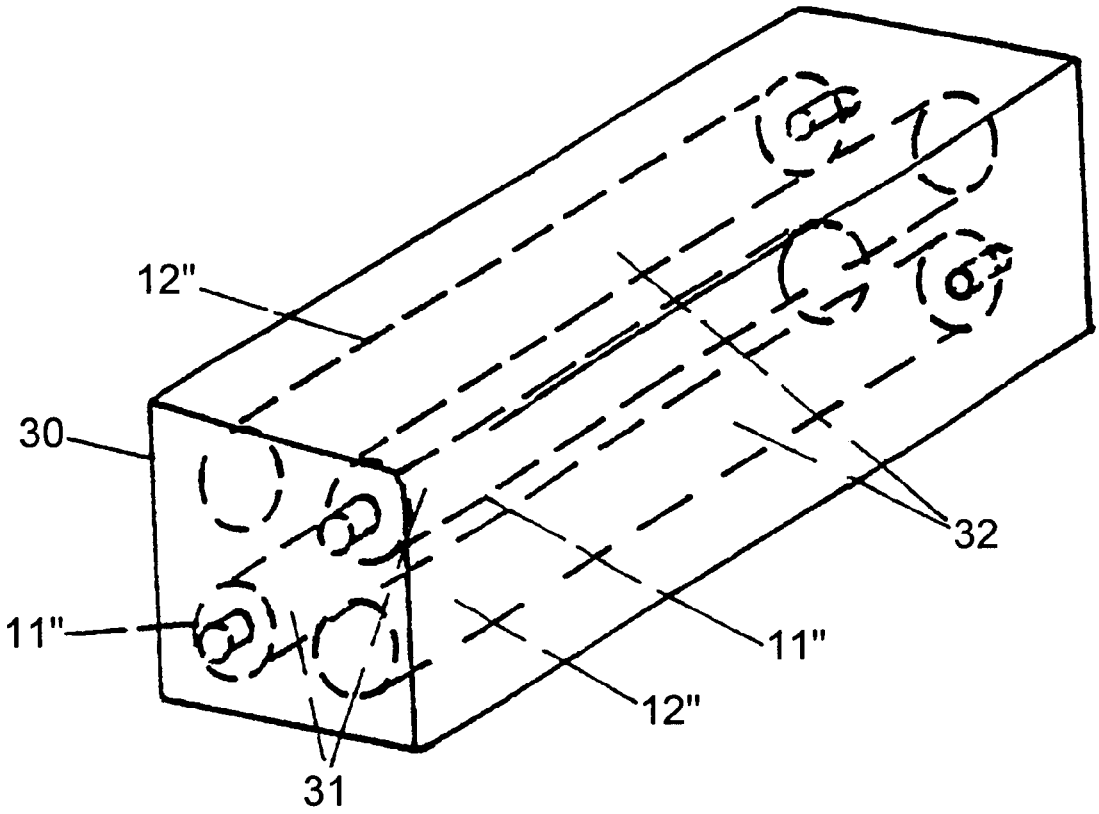

FIG. 4 shows schematically in perspective a modified design of the embodiment according to FIG. 3 with the cylinders made in a coherent construction of one and the same piece of material.

In FIG. 1 there is shown an aggregate 10 of two pressure medium cylinders 11,12 mutually secured together, as known per se, and with mutually parallel longitudinal axes 11*a*, 12*a*. The cylinders 11,12 are illustrated having mutually like designs.

The cylinders 11,12 have cylinder parts 13 and 14, which endwise are uniformly terminated and which are rigidly connected to each other via common fastening brackets 15 and 16, The cylinder parts 13,14 form, together with fastening brackets 15,16, a rigid and robust cylinder aggregate having effective bracing and shoring up between the cylinder parts 13,14.

In other words with cylinders 11,12, which are arranged by the side of each other, instead of after each other, the length dimension of the aggregate can be reduced and the construction of the aggregate thereby compressed by increasing the lateral dimension at the expense of the length dimension. Consequently the cylinder parts 13,14 will be able to brace each other mutually at the same time as the working volume of the cylinder parts 13,14 can be utilised in an economic manner.

The cylinders 11,12 are equipped with piston rods 17 and 18, which project endwise outwards in mutually opposite directions. In that the piston rods 17,18 project outwards in opposite directions each from its separate cylinder part 13,14 an effect is obtained, which not only corresponds to conventional double acting cylinders, but which yields double outgoing power. This is achieved in addition to the accumulated compressed length dimension of the aggregate.

In many cases of use, one can prevent, for example by pivotally connecting outer ends of the piston rods at associated fastening points, as a consequence of the mutual bracing between the cylinder parts, the occurrence during use of breakage of the piston rods at the transitions between piston rod and cylinder part.

In order to further reinforce the aggregate and counteract the tendency for breakage of the piston rods there can be arranged, as is shown in the alternative embodiment according to FIG. 2, extra support and/or bracing arrangements in connection with the solution which is shown in FIG. 1.

In FIG. 2 there is illustrated a first, transversely extending support member 20*a* or 20*b*, which on the one side is rigidly connected to the outer end of the piston rod 17 or 18 and on the other side is rigidly connected to a rod-shaped slide 21 or 22. The slides 21,22 are with the one end 21*a* fixedly connected with a first local fastening point 23, and with the one end 21*b* fixed connected with a second local fastening point 24. The slides 21,22 are arranged in the illustrated embodiment telescopically displaceable along a common central middle axis 25, which can be arranged centrally between the cylinders, if desired centrally through the aggregate.

Alternatively the one slide 21, in the form of a simple slide bar, passes centrally between the cylinder parts 11,12, as is shown in FIG. 2*a*, while the other slide 22, in the form of two parallel slide bars 22*a*, 22*b*, can pass just by and each on its side of the slide 21, with mutual shoring up between the slides 21,22 and possibly with extra shoring up of the cylinder parts 11,12, as is shown in FIG. 2*b*.

As illustrated in FIGS. 2*a* and 2*b* the piston rods are separately secured via other, obliquely extending support parts to the respective fastening point 23 or 24.

In FIG. 3 there is illustrated an aggregate of four cylinders, that is to say two pairs of cylinders 11',11' and 12',12', arranged in an annular aggregate 10' and fastened together with common end pieces 15' and 16'.

More specifically there is illustrated a first pair of cylinders 11',11' which are arranged directly above each other at a certain mutual spacing and which have the piston rods 17' directed axially outwards in the one axial direction. A second pair of cylinders 12', which are arranged correspondingly mutually directly above each other at a certain spacing, have the piston rods 18' directed in a direction axially opposite to the piston rods 17'. The cylinders 121 are arranged each on its side of the cylinders 11' to form said annular cylinder aggregate.

It is evident from FIG. 3*b* that piston rods 17' of the first cylinders 11' extend mutually parallel in a first plane, for example as shown in a vertical plane, while it is evident from FIG. 3*a* that the piston rods 18' of the second cylinders 12' extend mutually parallel in a second plane, for example as shown in a horizontal plane. The piston rods 17' can consequently be braced in the first plane, in the one end between fastening points (not shown) on the piston rods and the other end in associated cylinder 11'. The piston rods 18' can be braced correspondingly in the second plane at the one end between local fastening points and at the other end in associated cylinder part 12'. Consequently the second plane crosses the first plane. The cylinder parts 11',12', which are arranged in an annular arrangement, constitute for their part an effective junction for the bracing of both pairs of piston rods 17',18' in different planes between opposite ends of the cylinder aggregate 10.

As shown in FIGS. 3, 3*a*, and 3*b*, it is possible to equip the cylinder aggregate with additional cylinders, indicated at 17" and 18", for example with the cylinders arranged in a single ring or in two or more concentric rings. Alternatively, two or more cylinder aggregates can be arranged in a row.

In a favourable constructional design, as shown schematically in FIG. 4 two pairs of cylinders 11" and 12" can be fashioned in a common piece of material, for example in a common block-shaped construction 30, by boring out cylindrically hollow spaces 31,32 individually from mutually opposite ends of the piece of material. There can be obtained hereby a construction which is simple as to manufacture and use, but at the same time robust and concentrated.

What is claimed is:

1. An aggregate of pressure medium cylinders, comprising:

a plurality of first-type cylinders, each first-type cylinder having a first-type cylinder portion with a longitudinal axis and a first-type piston with an outer end, wherein the first-type piston is in displaceable relation with the first-type cylinder portion along the longitudinal axis and the outer ends of the first-type pistons are disposed in the same direction and rigidly connected to each other;

a plurality of second-type cylinders, each second-type cylinder having a second-type cylinder portion with a longitudinal axis and a second-type piston rod having an outer end, wherein the second-type piston rod is in displaceable relation with the second-type cylinder portion along the longitudinal axis and the outer ends of the second-type pistons are disposed in the same direction and rigidly connected to each other; and first and second common power-transmitting slides centrally arranged between the first-type and second-type cylinders and movable along a common axis, wherein the first-type and second-type cylinders are arranged in an alternating annular formation about an aggregate axis, the first-type and second-type cylinders portions are rigidly connected to each other in a longitudinally parallel manner, the outer ends of the first-type and second-type pistons are oppositely directed, the first-type pistons are connected to the first common power-transmitting slide, and the second-type pistons are connected to the second common power-transmitting slide.

2. The aggregate of claim 1, wherein the first-type and second-type cylinder portions are formed from a common piece of material.

3. The aggregate of claim 1, wherein the longitudinal axes of the first-type cylinder portions form a first plane, the longitudinal axes of the second-type cylinder portions form a second plane, and the first and second planes intersect each other.

4. The aggregate of claim 1, wherein the outer ends of the first-type pistons are located in a first plane.

5. The aggregate of claim 4, wherein the first plane is perpendicular to the longitudinal axis of the first-type cylinder portion.

6. The aggregate of claim 5, wherein the outer ends of the second-type pistons are located in a second plane.

7. The aggregate of claim 6, wherein the second plane is perpendicular to the longitudinal axis of the second-type cylinder portion.

8. The aggregate of claim 1, further comprising additional cylinders arranged an annular formation circumscribing the annular arrangement of the first-type and second-type cylinders.

9. The aggregate of claim 8, wherein the annular formation of the additional cylinders and the annular arrangement of the first-type and second-type cylinders are concentric.

10. An aggregate of pressure medium cylinders, comprising:

a plurality of first-type cylinders, each first-type cylinder having a first-type cylinder portion with a longitudinal axis and a first-type piston with an outer end, wherein the first-type piston is in displaceable relation with the first-type cylinder portion along the longitudinal axis of the first-type cylinder portion and the outer ends of the first-type pistons are disposed in the same direction and rigidly connected to each other;

a plurality of second-type cylinders, each second-type cylinder having a second-type cylinder portion with a longitudinal axis and a second-type piston rod having an outer end, wherein the second-type piston rod is in displaceable relation with the second-type cylinder portion along the longitudinal axis of the second-type cylinder portion and the outer ends of the second-type pistons are disposed in the same direction and rigidly connected to each other; and first and second common power-transmitting slides centrally arranged between the first-type and second-type cylinders and movable along a common axis, wherein the first-type and second-type cylinders are arranged in an alternating formation, the first-type and second-type cylinders portions are rigidly connected to each other in a longitudinally parallel manner, the outer ends of the first-type and second-type pistons are oppositely directed, the first-type pistons are connected to the first common power-transmitting slide, the second-type pistons are connected to the second common power-transmitting slide, the longitudinal axes of the first-type cylinder portions form a first plane, the longitudinal axes of the second-type cylinder portions form a second plane, and the first and second planes intersect each other.

11. The aggregate of claim 10, wherein the first-type and second-type cylinder portions are formed from a common piece of material.

12. An aggregate of pressure medium cylinders, comprising:

a block fashioned from a common piece of material having first and second opposing surfaces;

a plurality of first-type pistons, each first-type piston with an outer end and located in a first-type bore terminating at an opening of the first surface, wherein the first-type piston is displaceable along an longitudinal axis of the first-type bore, and the outer ends of the first-type pistons are rigidly connected to each other;

a plurality of second-type pistons, each second-type piston with an outer end and located in a second-type bore terminating at an opening of the second surface, wherein the second-type piston is displaceable along an longitudinal axis of the second-type bore, and the outer ends of the second-type pistons are rigidly connected to each other; and first and second common power-transmitting slides centrally arranged between the first-type and second-type cylinders and movable along a common axis, wherein the first-type and second-type bores are arranged in an annual formation about an aggregate axis, the longitude axes of the first-type and second-type bores are parallel to the aggregate axis, the first-type pistons are connected to the first common power-transmitting slide, and the second-type pistons are connected to the second common power-transmitting slide.

* * * * *